US006502697B1

(12) United States Patent
Crampton et al.

(10) Patent No.: US 6,502,697 B1
(45) Date of Patent: Jan. 7, 2003

(54) CONTAINER FOR ANAEROBIC PRODUCTS

(75) Inventors: Alan T. Crampton, Dublin (IE); Hilary E. Bryan, Stillorgan (IE); Fergal A. Gordon, Naas (IE)

(73) Assignee: Loctite (R&D) Limited, Dublin (IE)

( * ) Notice: Subject to any disclaimer, the term of this patent is extended or adjusted under 35 U.S.C. 154(b) by 0 days.

(21) Appl. No.: 09/446,068

(22) PCT Filed: Jul. 3, 1998

(86) PCT No.: PCT/IE98/00057

§ 371 (c)(1),
(2), (4) Date: Dec. 17, 1999

(87) PCT Pub. No.: WO99/02424

PCT Pub. Date: Jan. 21, 1999

(30) Foreign Application Priority Data

Jul. 7, 1997 (IE) ..... 970507

(51) Int. Cl.[7] ..... B65D 73/00
(52) U.S. Cl. ..... 206/484; 206/438; 206/447
(58) Field of Search ..... 383/1, 109, 9, 383/102; 229/117.27, 117.35; 206/484, 484.1, 484.2, 435, 447

(56) References Cited

U.S. PATENT DOCUMENTS

| | | | | |
|---|---|---|---|---|
| 2,895,950 A | | 7/1959 | Krieble | |
| 3,046,262 A | | 7/1962 | Krieble | |
| 3,173,579 A | * | 3/1965 | Curie et al. | 229/117.27 X |
| 3,218,305 A | | 11/1965 | Krieble | |
| 3,595,465 A | * | 7/1971 | Vaillancourt | 206/484.1 |
| 3,646,723 A | * | 3/1972 | Meroney | 383/9 X |
| 3,761,013 A | * | 9/1973 | Schuster | 383/109 X |
| 3,790,067 A | * | 2/1974 | Scheier | 383/1 |
| 4,180,640 A | | 12/1979 | Melody et al. | |
| 4,356,221 A | * | 10/1982 | Anthony et al. | 383/109 |
| 4,464,426 A | * | 8/1984 | Anthony | 383/109 X |
| 4,724,961 A | * | 2/1988 | Shimoyamada et al. | 206/439 |
| 4,778,699 A | | 10/1988 | Knox, III et al. | |
| 4,851,272 A | | 7/1989 | Knox, III et al. | |
| 4,863,770 A | | 9/1989 | Knox, III et al. | |
| 5,246,114 A | * | 9/1993 | Underwood | 206/524.8 |

FOREIGN PATENT DOCUMENTS

| | | |
|---|---|---|
| DE | 27 14 537 | 10/1978 |
| EP | 0 172 711 | 2/1986 |
| EP | 0 352 143 | 1/1990 |
| EP | 0 590 465 | 9/1993 |
| FR | 2 717 781 | 9/1995 |
| JP | 07 701 002 | 4/1995 |
| JP | 09 087 395 | 3/1997 |
| WO | 96/01766 | 1/1996 |
| WO | 97/32807 | 9/1997 |

OTHER PUBLICATIONS

Wiley Encyclopedia of Packaging Technology, 1986, wiley & Sons, Inc. 1986.*

* cited by examiner

*Primary Examiner*—Shian Luong
(74) *Attorney, Agent, or Firm*—Steven C. Bauman

(57) ABSTRACT

A container is described which is suitable for use with anaerobic products such as sealants and adhesives which cure, set-up or polymerise in the absence of air. The container is flexible having at least one wall made of a deformable, oxygen permeable material, which defines a cavity for receiving and retaining the anaerobic product. The wall may be made of polyethylene or polypropylene.

14 Claims, 3 Drawing Sheets

CONTAINER FOR ANAEROBIC PRODUCTS

FIELD OF THE INVENTION

The present invention relates to a container for anaerobic products in particular anaerobic sealants and adhesives, in particular liquid products. Anaerobic adhesives and sealants cure, set-up or polymerise in the absence of oxygen (air).

BACKGROUND OF THE INVENTION

The term anaerobic products as used here refers to formulations which cure, set-up or polymerise in the absence of air.

EP 0 352 143 describes an anaerobic liquid acylate sealant composition. U.S. Pat. No. 4,180 640 (Loctite) describes a hardenable adhesive and sealing composition. U.S. Pat. No. 3,218,305 (Krieble) discloses an anaerobic sealant composition. U.S. Pat. No. 2,895,950 and U.S. Pat. No. 3,046,262 (Krieble) also disclose anaerobic compositions. The products described in these specifications are examples of the type of product that may be stored in the container of the invention.

Containers or packages for storing anaerobic adhesive and sealant products are known. Typically such containers may be constructed from plastic, having substantially rigid walls, and capable of holding a number of liters of anaerobic product. Larger containers with pouring spouts are suitable only for low viscosity products. High viscosity products are not-easily decanted. It is known to provide semi-rigid plastic containers for such products. High viscosity products may be dispensed from containers by manual squeezing.

Rigid and semi-rigid containers are used with automatic dispensing machines. They do not readily conform to the shape of the dispenser and thus can create pockets of trapped (and therefore undispensing) products in the dispensing machine. High viscosity products tend to adhere to the walls of the container even if the container is pressurised, leaving a substantial amount of product within the container which is then wasted, or has otherwise to be removed from the container. A further disadvantage of such containers is the shelf life of products and particularly of anaerobic products placed in such containers if the container is filled beyond a certain level. Containers for anaerobic products are ordinarily left with a headspace above the level of liquid in the container. Typically 30% to 60% of the internal volume of the container is left unfilled with anaerobic product, depending on the rigidity of the side wall of the container in order to give a sufficient shelf-life. This allows a sufficient volume of air (oxygen) to remain within the container to help stabilise the anaerobic product. There exists however a conflict between the necessity to seal in the product on the one hand and to allow air (oxygen) to permeate through the product on the other. Such containers when filled or nearly full do not provide commercially acceptable shelf life for anaerobic products, as there is not sufficient air (oxygen) present in the container, nor does sufficient air permeate into the container. There is therefore substantial wastage of packaging materials and higher costs due to the partial filling of containers with this product.

Containers made from air-permeable material allow air through their walls etc. This air may replace air in the headspace or may permeate into the product within the container. However in order to ensure stability of anaerobic products permeation into the headspace alone is not sufficient to ensure adequate shelf-life. The air must permeate through the product also to ensure curing, setting up or polymerisation of the product does not occur. The area where curing, setting up or polymerisation is most likely to first occur is at the centre of the mass of product. Thus even with an air permeable container, and headspace of air in the container, curing or setting up or polymerisation may take place prematurely giving the product a shorter than desired shelf-life. The problem of curing or setting up is exacerbated by elevated storage temperatures. It is known to refrigerate, for example at temperatures of 2–8° C., certain anaerobic products which are sensitive to polymerisation, curing or setting up (particularly those of high viscosity) in order to prevent premature curing. Temperatures greater than about 28–30° C. cause even more rapid curing or setting up of anaerobic products.

An example of one of such containers is commonly referred to as a "cubitainer" [commercially available from Dynopack Ltd. in the U.K.]. The name stems from its cubic shape. The container is constructed from a typically translucent plastic constructed from low density polyethylene/ethylene vinyl acetate (LLDPE/EVA) copolymer mixed with linear low density polyethylene (LLDPE) with a wall thickness of about 160 $\mu$m to 180 $\mu$m. A nozzle with a threaded cap is fitted at the centre of the top wall of the container. Typically the cubitainer has a 3 liter internal volume, which is used to hold 1 liter or 2 liters, of an anaerobic adhesive. The less anaerobic adhesive placed in the cubitainer the greater the shelf-life of the adhesive.

The cubitainer has a continuous welded seam which runs about the outside of the container. The seam runs along one side of the base wall, then diagonally across a first side wall, then across one side of the top wall and then diagonally down a second side wall opposite the first side wall to meet the base wall to form a continuous seam about the container.

The container is relatively rigid, though its contents can be dispensed manually by squeezing the walls of the container to some extent. However, users of the cubitainer have noticed that substantial amounts of medium to high viscosity product remain in the container despite manual pressure, causing them to resort to cutting open the container to remove the contents. The cubitainer is packaged within an external paperboard carton which prevents physical damage to the plastic walls and allows stacking. The oxygen permeability of the cubitainer at 20° C. and 350 $\mu$m wall thickness is about (546 $cm^3/m^2$.day.atm) 553 $cm^3/m^2$.day.bar.

When partially full the cubitainer provides a storage means for anaerobic containers which gives the product an excellent shelf life. However as stated above partially filled containers are wasteful of materials and energy. It is of course possible to fill the cubitainer completely, but in practice it has not been filled as this would compromise the shelf-life of the product. Furthermore the cubitainer is suitable only for low to medium viscosity products, not for medium to high viscosity products due to their "difficult to pour" nature. High viscosity products have been traditionally sold in "bucket with lid" containers i.e. a very wide mouthed container (and thus large) to allow the product to be removed manually from the container.

The containers described above are all "stand-alone" containers i.e. the rigidity of the side-walls is sufficient to allow the container to stand without falling over or deforming to any appreciable extent under internal pressure from its contents. To make a stand-alone container it is necessary to conform to a base area:height ratio which makes the container stable when standing. The cubitainer described above is packaged in a paperboard carton to protect it from damage during transport, storage and the like. The cubitainer is a stand-alone container, its cubic shape and relatively rigid side walls allowing it to stand on its base.

Another form of container used for high viscosity anaerobic products is a cartridge having a nozzle and a built-in piston from which product is dispensed by a dispensing gun etc. No headspace is left in the cartridge. This severely limits the shelf-life of the product. Furthermore the amounts placed in these cartridges are relatively small, of the order of 300 ml to 800 ml. Larger volumes would result in an even shorter shelf-life of the product.

A collapsible container is known from EP-A-0172711 which is suitable for use with medicaments or other liquids which must be preserved from contamination. Likewise EP-A-0590465 relates to a composite film barrier for packaging oxygen-sensitive products. These containers are intended to prevent the ingress of air into the interior of the container and therefore would not be suitable for use with anaerobic products which would cure or polymerise in the absence of air (oxygen).

Composite films for bag-in-box-type containers are known from JP-A-07 701 002-A (see Derwent Abstract: Accession No. 95-182607 [24]). Such films are made from outer layers of ultra-low density polyethylene or linear low density polyethylene with an intermediate gas barrier layer. The gas barrier layer may be of polyamide resin layer, saponified ethylene-vinyl acetate copolymer layer and polyamide resin layer or alternatively of polyamide resin layer, polyolefin adhesive resin layer and saponified ethylene-vinyl acetate copolymer layer. The outer and intermediate layers are bonded by adhesive resin. The films are described as having good gas barrier properties and are thus useful for storing food products and chemicals.

Similar products are known from U.S. Pat. No. 4,863,770, U.S. Pat. No. 4,851,272 and U.S. Pat. No. 4,778,699 and all are considered to have good oxygen or gas permeation barriers.

Anaerobic products in the types of container described above have been available commercially for some time. There therefore exists a need to provide a container for anaerobic products which:

(i) confers excellent shelf life stability on anaerobic products;

(ii) may be used to store any one of low, medium or high viscosity products while allowing the product to be dispensed manually or to be dispensed automatically from a dispensing apparatus, without difficulty, and which may be filled to a level where the headspace in the container is minimised; and (iii) prevents the anaerobic product from escaping from the container, but does not exclude air by permeation into the container i.e. does not provide a substantial barrier to the permeation of air.

A minimal headspace typically does not exceed the volume of the nozzle/cap. However it will be appreciated that achieving a headspace of less than 20% of the container would be a significant improvement over prior art containers, when the shelf-life of the product is not compromised by the minimal headspace.

SUMMARY OF THE INVENTION

The present invention provides a flexible container for anaerobic products comprising at least one wall defining a cavity for receiving and retaining an anaerobic product, the wall being made of a deformable, oxygen permeable material, such that the container is sufficiently flexible to substantially conform to the shape of a further container into which it may be placed.

The flexible container may be made of a thin layer or layers of an oxygen-permeable material such as polyethylene or polypropylene and formed in the shape of a bag. Suitable materials are linear low density polyethylene, very low density polyethylene, high density polyethylene or polypropylene or blends, co-extrusions or laminates of these products. The flexible container may comprise two or more layers of oxygen permeable material. The wall thickness may be at least 50 $\mu$m and the permeability of a wall is suitably 25 $cm^3/m^2$.day.bar or greater. The flexible container may be opaque. This is desired where the product is light sensitive.

In another aspect, the invention provides a pack which comprises a flexible and a rigid container. The flexible container may be provided in an outer substantially rigid oxygen permeable container which can hold the flexible container and can retain the flexible container in use in a predetermined shape when containing anaerobic product. The outer container retains the flexible container in its optimum position for allowing oxygen to permeate through to the anaerobic product. This gives an excellent shelf-life while the container in which the adhesive is stored is flexible and allows products to be dispensed easily. The product may be decanted or dispensed irrespective of its viscosity.

A low viscosity anaerobic product contained within the flexible container may be dispensed without removing the flexible container from the outer container if the outer carton is so adapted. In particular the flexible container may be provided with a nozzle which may be opened or closed to dispense the contents of the flexible container.

In one aspect of the invention, the flexible container comprises a plastic bag and the outer container comprises a substantially rigid carton. The carton may comprise paperboard and may be of a flattened or flatpack shape. In other words, one dimension of the pack may be substantially less than the other two dimensions e.g. the width and depth may be greater than the height. Suitably, in use, the outer container retains the flexible container when containing a mass of anaerobic product to a shape in which the distance from any point in the product to a wall is less than or equal to 4 cm.

DETAILED DESCRIPTION OF THE DRAWINGS

A flexible container of the invention will now be described with reference to FIGS. 1 to 4.

The flexible container is generally designated 1.

Figure 1:
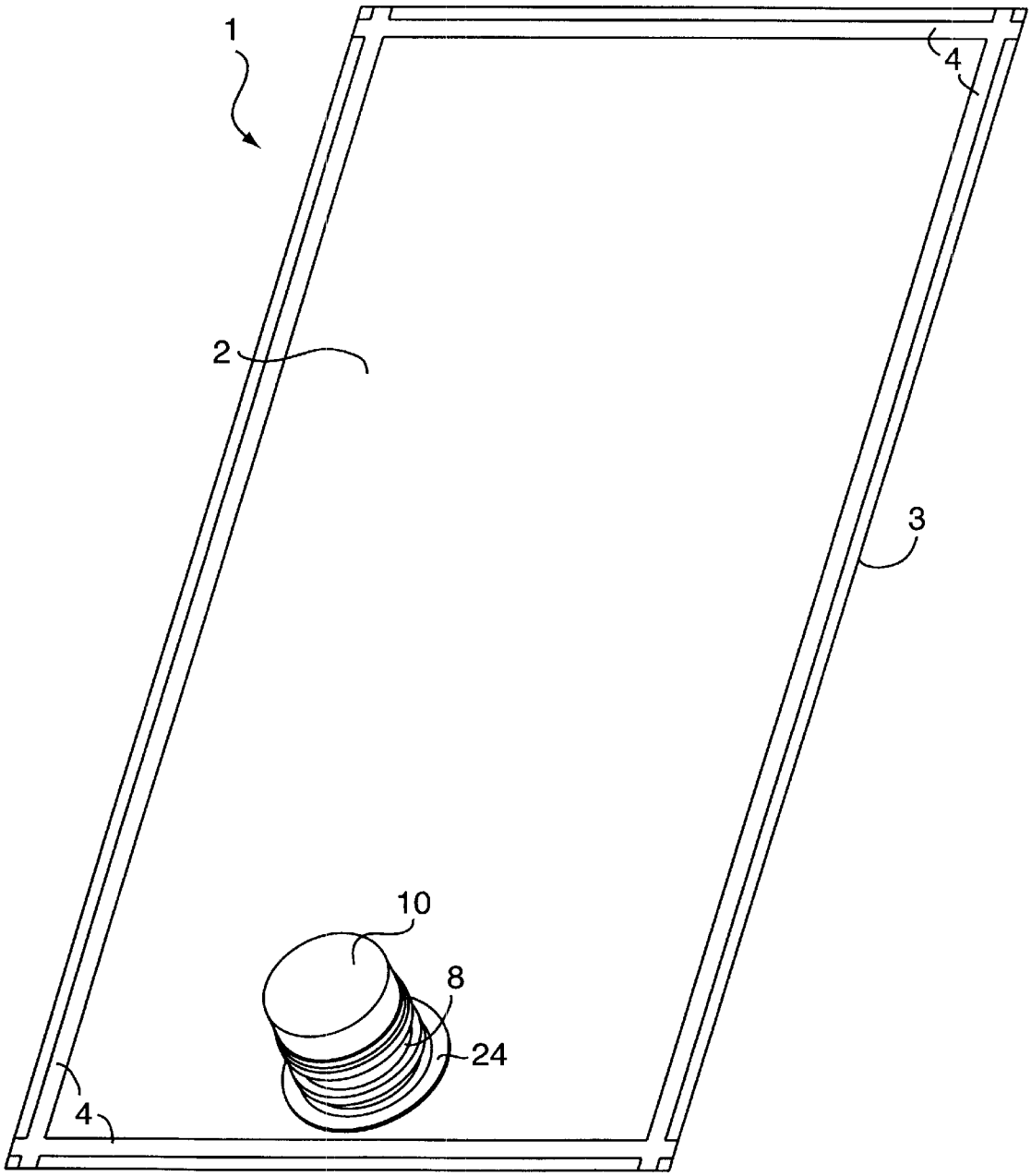
FIG. 1 is a perspective view of a flexible container of the invention.

As can be seen from FIG. 1 the flexible container 1 depicted therein is rectangular in shape. The flexible container 1 is made from thin layers of an oxygen permeable material, which for example may be linear low density polyethylene (LLDPE). LLDPE is air/oxygen permeable. The flexible container 1 has two opposing walls: a first wall 2 and a second wall 3; each wall formed from two layers of LLDPE. A weld or join 4 runs about the perimeter of the flexible container 1 a short distance from its edges. The weld 4 joins the walls 2,3 together to form a sealed bag shape. The flexible container 1 has also a nozzle or spout 8 fitted to the first wall 2. A flange 7 beneath wall 2 (of FIG. 4) supports the nozzle 8. The flange 7 is sealingly fitted to the first wall 2 by a weld 24 about the flange. The flange 7 and the nozzle 8 are formed as a single piece. The nozzle 8 is fitted with a screw-threaded stopper or cap 10 which is used to retain the product in the flexible container 1 when the flexible container holds product. When empty the flexible container 1 is flat in the configuration of FIG. 1. It is generally rectangular in shape. It will be appreciated that any given wall of the container may comprise one or more layers. A single layer may comprise one or more plies of material. The most preferred material is plastics material particularly polyethylene or polypropylene. Each wall/layer or ply may be a laminate a co-extruded product, or a blended product.

Figure 2:
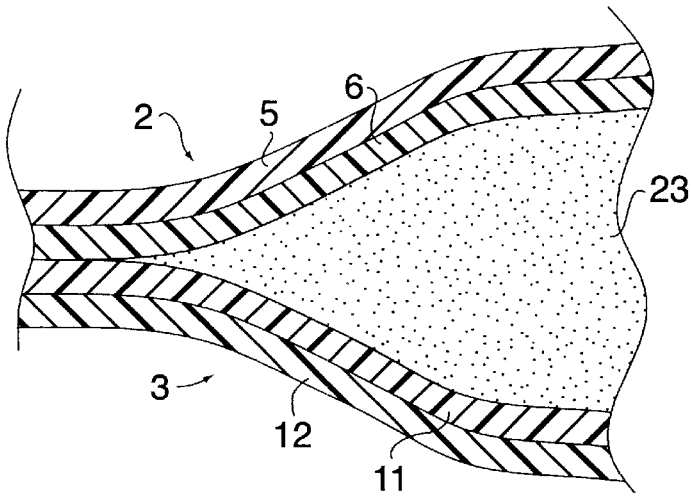
FIG. 2 is a magnified part-sectional view of the flexible container of FIG. 1.

FIG. 2 shows a side view of the flexible container of FIG. 1. In particular it can be seen that the first wall 2 comprises two layers 5,6 of LLDPE film, while second wall 3 also comprises two layers 11,12. The layers of first wall 2 and the layers 11,12 of second walls 3 are held together only by the weld 4. In particular layers 5 and 6 of the first wall 2 are not bound or sealed together over their surface area. Neither are the layers 11,12 of second wall 3.

Figure 3:
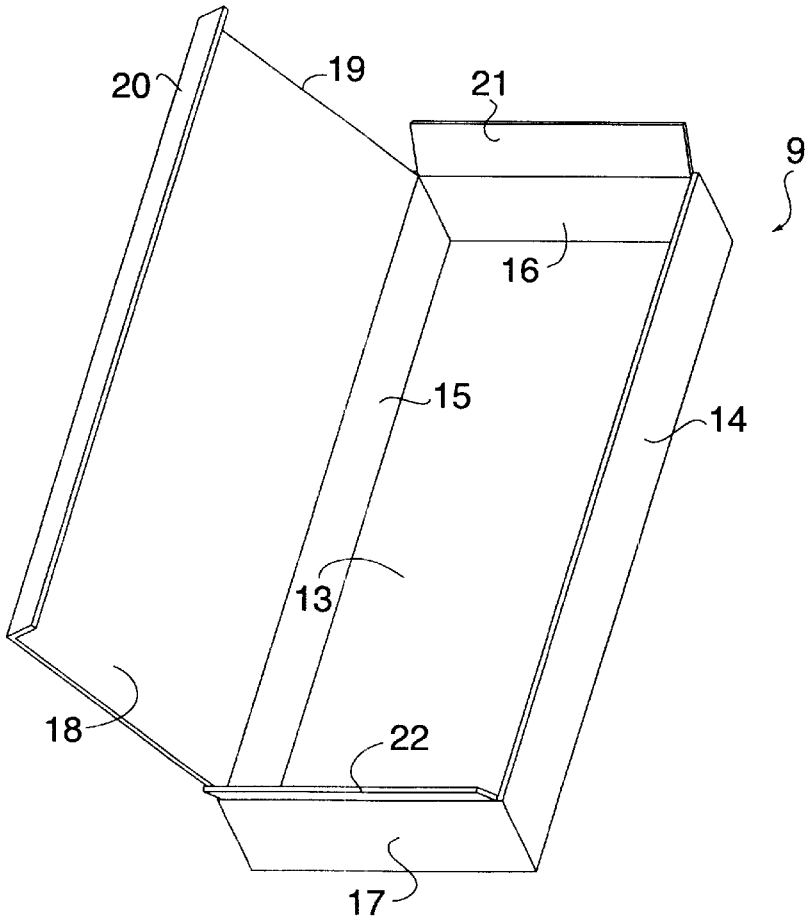
FIG. 3 is a perspective view of an outer container for the flexible container of FIG. 1.

FIG. 3 shows a perspective view of an outer container or carton 9, which is made from paperboard. The container 9 has a base 13, two side walls 14,15 and two end walls 16,17. The container 9 has a paperboard lid 18 comprising two hinged pieces 19,20. The lid 18 is movable between a closed position and an open position. The container 9 has two further tuck-in flaps 21,22 which function to hold the lid 18 in a closed position. Other flaps (not shown) may be used to hold the lid in the closed position. The internal height of the outer container should be less than 80 mm, desirably less than 60 mm. In the embodiment described the internal height is approximately 50 mm. The other dimensions of the container 9 are determined by the flexible container 1 as the outer container 9 is adapted to receive the filled or almost filled flexible container 1. When filled with anaerobic product the flexible container 1 fits snugly within the outer container 9. The flexible container 1 and the outer container 9 may be of any required shape. Suitably they have complementary shapes. The bottom wall of flexible container 1 fits into the container 9 and in particular rests on base 13. The flexible container 1 is then constrainable by two perimeters when the outer container 9 is in its closed configuration: the first is the internal perimeter about the width of the outer container 9; the second is the internal perimeter about the length of the container. The flexible container 1 fits these dimensions within a tolerance of up to 10 mm less than the corresponding dimension of the container. Bulging of flexible container 1 is prevented by the outer container 9 which keeps the product evenly distributed within the flexible container 1.

Figure 4:
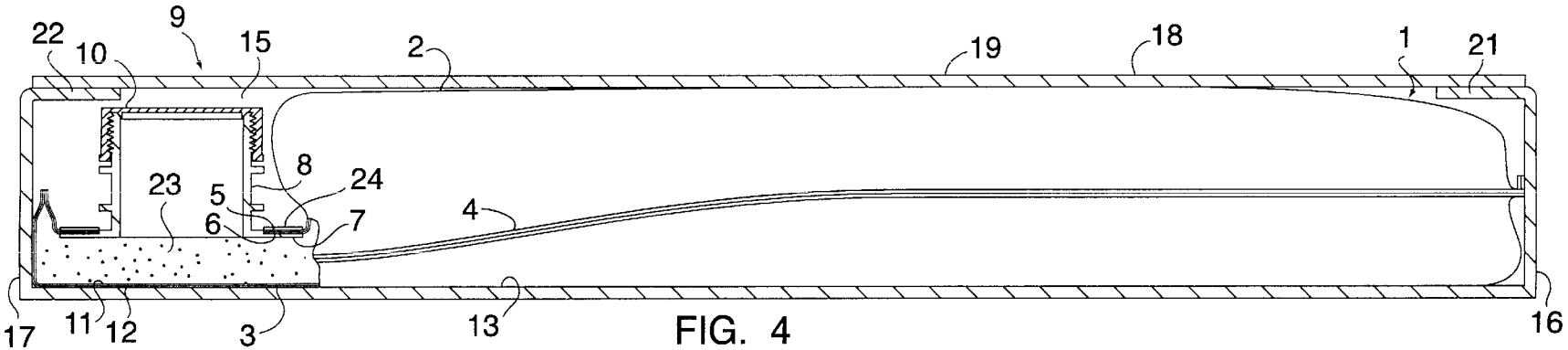
FIG. 4 is a sectional view of the flexible container of FIG. 1, filled, and enclosed in the outer container of FIG. 3.

The flexible container 1, filled with anaerobic product, and placed in the outer container 9 (now closed) is shown in FIG. 4. The two layers 5,6 on the top wall 2 and the base wall 3 allow for trapping of any anaerobic product which may weep from the internal cavity of the container 1, between the layers of each wall.

Known packaging presents a high barrier to air (oxygen) permeability whereas the flexible container 1 of the present invention presents a low barrier.

The outer container 9 retains the flexible container 1 in the shape shown in FIG. 4. The flexible container 1 is restrained in height by the internal height of outer container 9 i.e. upper wall 2 of flexible carton 1 is restrained by lid 18 while lower wall 2 of flexible container 1 is restrained and supported by base 13. The flexible container 1 cannot exceed in height the internal height of outer container 9 between lid 18 and base 13. End walls 16 and 17 of outer container 9 fit snugly against the ends of the flexible container 1, holding flexible container 1 against movement during transport. Without the outer container 9 the container 1 may become folded, creased or otherwise deformed during transport or storage. The outer container 9 prevents this and also provides a generally rectangular box shape which may be easily stacked, stored and the like. The flexible container 1 is maintained in a generally flat shape, having a relatively large surface area and allowing oxygen to permeate through all of the mass of anaerobic product 23 in the flexible container 1, as the distance from the walls 2,3 to any point in the product is relatively small. The flat shape may be generally referred to as a "flatpack" shape. The flexible container 1 is thus maintained with optimum exposed surface area for permeation of oxygen through the flexible container 1.

The outer container 9 need not be constructed of oxygen permeable material. It may be made of an impermeable material which allows air into the interior of the container e.g. by providing small apertures in the container etc. The outer container 9 may also be designed to carry a multiple of flexible containers 1. Each flexible container 1 may be separated from the others by a divider which may be oxygen permeable. Alternatively the flexible containers 1 may be held in a spaced apart arrangement by other means.

The flexible container 1 takes up the shape of a pressure pot dispenser it is placed in. This allows anaerobic product (of low to high viscosity) to be dispensed without direct contact between the anaerobic product and the user. An anaerobic product having low to medium viscosity may also be decanted without removing the flexible container 1 from the outer container 9. High viscosity anaerobic products may be squeezed by hand from the flexible container 1 or may be dispensed as above. The flexible container 1 may be removed from the outer container 9 before dispensing product therefrom.

The flexible container 1 may be used with a pressure pot dispenser such as that described in International patent application No. PCT/IE97/00015 the disclosure of which is hereby expressly incorporated herein by reference.

The container 1 can be specifically designed to have a snug fit within any of a variety of pressure pot dispensers. In general the circumference of the flexible container 1 when filled with product can be made to match closely the internal dimensions of the cylindrical cavity of any pressure pot dispenser. The nozzle 8 is designed to be held by a collar of the pressure pot dispenser, so that a dispensing nozzle may pierce the cap and allow the anaerobic product to be expressed from the flexible container 1 without the need to remove the cap 10 from the flexible container 1.

It will be noted that the flexible container 1 is of sufficient flexibility to conform to the shape of a container in which it is placed, provided that the container has dimensions which restrict the shape of the flexible container 1 in some way. For example outer container 9 restricts the height of flexible container 1, while a pressure pot dispenser may have a cylindrical cavity which conforms the flexible container 1, at least in cross section, to a generally cylindrical shape. Furthermore the flexible container 1 may be folded, for example folded upon itself by the pressure piston of a pressure pot. Substantially all of the anaerobic adhesive 23 may thus be dispensed from flexible container 1.

The flexible container 1 of the invention can be of any shape as long as it retained the flatpack shape described above. In particular the flexible container and or the mass of adhesive should have at least one dimension height/width/length which is not greater than about 8 cm. It is most convenient if it is the height of the container which does not exceed 8 cm.

A suitable method for calculating the approximate value to which one dimension of the container would be restricted is to use the formula:

$$\text{maximum value of restricted dimension} = 5/9\ (\text{Volume of flexible container})^{1/3}$$

(i.e. calculate 5/9 of the cubic root of the volume ($cm^3$) and take this number as the restricted dimension (cm) e.g. height (cm)).

The flexible container 1 may have side walls of 50 $\mu$m or greater thickness. The side walls may comprise a number of layers or plies at least one of which is about 50 $\mu$m or greater in thickness. In the embodiment illustrated the flexible container 1 has two plies each of 70 $\mu$m thickness.

The flexible container 1 may contain different volumes of product and still have a minimal headspace. It will be appreciated that due to the flexible nature of the flexible container 1, the headspace can be minimised at any level of fill of product. Air may be expressed from the flexible container 1 so that there is effectively left only the headspace of the internal volume of the nozzle 8.

When a nominal volume for the flexible container 1 is stated, this is to be taken as the target minimal fill of the flexible container 1 (a minimal fill is requested for manufacturing purposes). The flexible container 1 may have an internal volume which exceeds the nominal volume particularly where the shape of the flexible container 1 is unrestrained and the sides may bulge when being filled. The outer container 9 has a direct bearing on the nominal volume of flexible container 1 as it constrains the flexible container 1 to given dimensions. The flexible container 1, combined with the restraining forces of the outer container 9 and the internal pressure (due to the volume present) of the anaerobic product are combined in the present invention to provide a flatpack shape for the flexible container 1 when in use i.e. the flexible container 1 does not crease or fold on itself to any substantial degree. A degree of overfill as compared to the nominal volume can be accommodated. The term 'headspace' refers to the internal volume of the container which is unoccupied by product and is normally occupied by air. The flexible container 1 may be opaque, translucent or transparent. Where the anaerobic product is light sensitive it may be opaque.

The following examples are provided only for illustrative purposes, and are in no way intended to limit the teaching as set forth herein.

The following abbreviations are used in the following examples:

PE=polyethylene

HDPE=high density polyethylene

LLDPE=linear low density polyethylene

VLDPE=very low density polyethylene

"CUBIC"=cubicontainer product described above (3 liter internal volume)

"5LHDPE"=natural HDPE bottle, rectangular shape, approx. 1 mm thickness having 5 liter capacity "Black HIDPE"=HDPE bottle, black in colour, round in shape, walls approximately 1 mm in thickness and having a 1.75 liter capacity. The oxygen permeability of the-'Black HDPE' is approximately 30 $m^3/m^2$.day.bar.

"Red"=LDPE bottle, red in colour, oval in shape, walls approximately 1 mm thickness, and of 400 ml capacity. The oxygen permeability of the 'red container' is 150 $cm^3/m^2$.day.bar.

"Natural LDPE"=LDPE bottle, natural, round in shape, approx. 1 mm in thickness of 1.75 liter capacity.

"LDPE Bag"=LDPE bag (equivalent to flexible container 1), constructed of two layers of 70 $\mu$m LLDPE (natural), having a 2 liter capacity.

The word "natural" refers to an uncoloured product i.e. one of natural colour to which no dye has been added.

EXAMPLE 1

Dimensions of Flexible Container 1

EXAMPLE 1.(a): Example of typical dimensions of a flexible container 1 and its outer container 9 are given below:

Construction: Upper and lower walls each 2 ply, formed in a rectangular shape and welded with a 6 mm weld. The outer ply in each case was constructed of PE/HDPE/PE (code A057/1), the inner ply LLDPE (70 $\mu$m).

Length and width are measured inside weld to inside weld.

Dimensions of Flexible Container 1:

Length (cm): 27.5–28.5 Width (cm): 24.5–25.5

Nominal volume (liter): 2

Distance from inside weld to centre of nozzle: from end 4.5 to 5.5 cm: from side 12.3 to 12.7cm Dimensions of Outer Container 9:

Length internal (cm): 25.5 Width internal (cm): 32 Height internal (cm): 19.0 Thickness of Walls (cm): 0.3

EXAMPLE 1(b) Example of typical dimensions of a flexible container 1 and its Outer Container 9 are Given below Construction: Upper and lower walls each 2 ply, formed in a rectangular shape and welded with a 6 mm weld. The outer ply in each case is LLDPE (clear) 70 $\mu$m film. The inner ply in each case is LLDPE (clear) 70 $\mu$m film. (This flexible container 1 is code A057/3).

Dimensions of flexible container 1:

Length and width are measured inside weld to inside weld.

Length(cm) 33.5±0.5 Width(cm) 20.0±0.5

Nominal Volume (Liter): 2

Distance from inside weld to centre of nozzle: From end (cm): 5.0±0.5 From side (cm): 10.0±.0.5

Dimensions of outer container 9:

Length internal (cm): 37.5 Width internal (cm): 14.0

Height internal (cm): 5.0 Thickness of Walls (cm): 10.3

EXAMPLE 2

$O_2$ Permeability of Material which may be used to Construct Flexible Container 1

TEST MATERIALS: Sample D (code A057/3):clear 70 $\mu$m VLDPE/LLDPE blend. Sample E (code A057/1):clear HDPE/LLDPE co-extrusion.

TEST CONDITIONS: 23±1° C., 50±2% rh (relative humidity)

TEST METHOD

ASTM D3985-81, Coulometric method using the Oxtran 2/20 apparatus with computer control. Each specimen was mounted to create a membrane between two chambers. Both chambers were initially flushed with a carrier gas. When steady conditions were established, oxygen was flushed through the upper chamber. The sensor was activated to detect the oxygen that had permeated through the specimen and measurements were taken over the course of several hours until the system had reached equilibrium and constancy in the result was reached. The samples were tested to 1% oxygen in nitrogen and the results are quoted for 100% oxygen, 4 replicate tests per sample.

Oxygen Permeability ($cm^3/m^2$.day.atm)

| | Mean | Range |
|---|---|---|
| Sample D(code A057/3) | 2728 | 2586–2848 |
| Sample E(code A057/1) | 1494 | 1446–1544 |

EXAMPLE 3(a)

Performance and Stability Testing of Loctite Product No. 121078. Product 121078 is a Single Component Anaerobic Retaining Adhesive Based on an Urethane Methyacrylate Monomer.

1 liter of product 121078 was stored at RT in a 3 liter flexible container 1 which has walls constructed of 2 plies of 70 $\mu$m natural LLDPE. The flexible container 1 was inflated with 2 liters 8 as to mimic a 3 liter cubitainer with a 1 liter fill.

On heating at 45° C. for 4.5 months or 3 months the flexible container 1 performed similarly to the cubitainer.

EXAMPLE 3(b)

Loctite product no. 121078: was heat aged at 55° C., 45° C. and 35° C. and was also stored at room temperature in each of the following containers with the specified amount of product 5LHDPE (2 liters of 121078), Black HDPE (1 liter of 121078), Cubic (1 liter of 121078), RED (250 ml) in natural LDPE (1 liter of 121078) and flexible container 1 (2 liter fill). The performance of the product stored in the flexible containers (as above) with a 2 liter fill was similar to that of the product in the 3 liter cubitainer with a 1 liter fill (and again with a two liter headspace of air) and superior to the performance of product stored in the other containers. Failure of the test was judged to have occurred where there was a significant increase in viscosity of the product and/or partial (lumps) or complete gellation of the product.

For the samples heat-aged at 55° C., the cubitainer and the flexible container (1) outperformed the other containers containing 1 liter or greater of product. The time to product gellation was approximately sevenfold that the other containers and had a performance similar to the 'Red' container above which held only 250 mls of product. At 45° C. the performance of the cubitainer and flexible container gave a time to product gellation in excess of eightfold that of the other containers containing 1 liter or more and similar to that of the 'Red' container. At 35° C., with testing not completed, the cubitainer and flexible container had outperformed the other containers containing 1 liter or more by threefold, and again had a performance similar to the 'Red' container.

EXAMPLE 4

The pin and collar test was used to determine the shear strength of an adhesive joint of the adhesive between a metal pin and metal collar. The pin and collar test is a standard test in the industry.

Viscosity was determined in the usual way using a Brookfield RVT using the appropriate spindle at two different settings of the revolutions per minute. Viscosity tests on a Brookfield RVT is a standard test.

The percentage weight loss of product was also determined. The pin and collar (P & C) test of the viscosity and weight test were all used to judge the storage characteristics of the containers, by testing the performance of the anaerobic product which was heat aged or stored at room temperature (22° C. in the container).

A series of proprietary products of Loctite (Ireland) Ltd. listed below were each stored in two different 2 liter flexible containers—those of Examples 1(a) and 1(b), (2 liter fill—the headspace was the amount of air in the nozzle 8). The cubitainer was used as a reference to judge the performance of these products when heat-aged at 45° C. for 7 weeks and 35° C. for 14 weeks. Viscosity measurements, the pin and collar test and weight loss of product were used for comparative tests between products stored in the cubitainer and that stored in identical conditions in each of the flexible containers 1. For product nos. 275 and 242 the torque strength required to break a coarse threaded nut and bolt when locked together by the product ('BONB' test) instead of the pin and collar test. The cubitainer was placed in its standard paperboard carton for each of the tests. The flexible containers were stored, two side by side in a paperboard carton for convenience.

The products tested were as follows:

| Loctite Product Reference No. | Viscosity in Cp's @ 25° C. (H) = high viscosity (M) = medium viscosity (L) = low viscosity | Description |
|---|---|---|
| 121078 | Spindle 3, 2.5 rpm 14,000 (H) | Single component anaerobic adhesive based on urethane methacrylate monomer. Used to bond close fitting metal surfaces. |
| 574 | Spindle 6, 2.5 rpm 50,000–150,000 (H) | Dimethacrylate ester monomers. Single component, thixotropic anaerobic sealant. Used as a form-inplace gasket on rigid flanged components e.g. gear box and engine casings etc. |
| 577 | Spindle 5, 2.5 rpm 50,000–110,000 (H) | Dimethacrylate ester monomer. Single component, medium strength thixotropic anaerobic sealant with fast curing properties. Used to seal metal threaded fittings. |
| 573 | Spindle 6, 2.5 rpm 30,000–90,000 (H) | Dimethacrylate ester monomer. Single component, thixotropic anaerobic sealant which develops medium strength. Used as form-in-place gasket e.g. gear box and engine casings etc. |

-continued

| Loctite Product Reference No. | Viscosity in Cp's @ 25° C. (H) = high viscosity (M) = medium viscosity (L) = low viscosity | Description |
|---|---|---|
| 275 | Spindle 5, 2.5 rpm 17,500–52,500 (H) | Dimethacrylate ester monomer. A one component anaerobic material which is thixotropic and has high strength. Prevents loosening through vibration and leakage of threaded fasteners. |
| 542 | Spindle 5, 2.5 rpm 925–2775 (M) | Dimethacrylate ester monomer. A single component anaerobic pipe sealant material. Used to lock and seal hydraulic and pneumatic fittings and for sealing threaded metal fittings. |
| 242 | Spindle 2, 2.5 rpm 4,000–8,000 (M) | Dimethacrylate ester monomer. A one component anaerobic material which is thixotropic and has medium strength. Used as a thread locking composition. |
| 638 | Spindle 3, 20 rpm 1,800–3,300 (M) | Urethane methacrylate monomer. A single component anaerobic adhesive which develops high strength rapidly. Used for example to lock bushings and sleeves into housings and on shafts. |
| 648 | Spindle 2, 20 rpm 400–600 (L) | Urethane methacrylate monomer. Used as a single component anaerobic retaining adhesive which develops high strength rapidly. Applications include holding gears and sprockets onto gearbox shafts and rotors on electric motor shafts. |

All the above products are available from Loctite (Ireland) Ltd., Dublin, Ireland under the given product reference number. The above products include low, medium and high viscosity products.

The term low viscosity is defined as a material of 0–1000 Cps.

The term medium viscosity is defined as a material of 1,000–10,000 Cps.

The term high viscosity is defined as a material of 10,000–3,000,000 Cps. These viscosity ranges are based on the Brookfield RVT test and on the viscosity measurement taken at the lower revolution per minute figure for the test.

Results

The results of the tests are set out in the following nine tables.

Product 121078 - Stability in 2L Bags

| | | Cubi 1 Liter | A057/3 2 Liter | A057/1 2 Liter |
|---|---|---|---|---|
| 7 Wk at 45 C. | Code | 82 | 85* | 88 |
| % Wt Loss | 1 Wk | 0.34 | 0.48 | 0.18 |
| | 2 Wk | 0.63 | 0.87 | 0.34 |
| | 3 Wk | 0.88 | 1.2 | 0.49 |
| | 7 Wk | 1.45 | 2.06 | 0.88 |
| Viscosity (mPas) | #4, 2.5 rpm | 8608 | 8480 | 8240 |
| | #4, 20 rpm | 3290 | 3240 | 2860 |
| P & C (N/mm2) | 15 min | 0 | 0 | 0 |
| | 24 Hr | 20.7 | 21.6 | 21.2 |
| 14 Wk at 35 C. | Code | 81 | 84* | 87* |
| % Wt Loss | 3 Wk | 0.48 | 0.57 | 0.99 |
| | 4 Wk | 0.55 | 0.66 | 1.05 |
| | 5 Wk | 0.65 | 0.79 | 1.11 |
| | 10 Wk | 1.18 | 1.44 | 1.45 |
| | 14 Wk | 1.58 | 1.86 | 1.66 |
| Viscosity (mPas) | #4, 2.5 rpm | 7120 | 8240 | 7360 |
| | #4, 20 rpm | 2920 | 3050 | 2980 |
| P & C (N/mm2) | 15 min | 0 | 0 | 5.00 |
| | 24 Hr | 20.08 | 21.37 | 20.89 |

A057/1 Outer Ply PE/HDPE/PE Inner Ply LLDPE 70 u
A057/3 Outer Ply LDPE 70 u Inner Ply LLDPE 70 u Product 574 - Stability in 2L Bags

| | | Cubi 1 Liter | A057/3 2 Liter | A057/1 2 Liter |
|---|---|---|---|---|
| 7 Wk at 45 C. | Code | 72 | 75 | 78 |
| % Wt Loss | 3 Wk | 0.68 | 1.05 | 0.57 |
| | 4 Wk | 0.85 | 1.34 | 0.72 |
| | 5 Wk | 1.02 | 1.59 | 0.85 |
| | 7 Wk | 1.27 | 2 | 1.08 |
| Viscosity(mPas) | #6, 2.5 rpm | 161200 | 166800 | 152000 |
| | #6, 20 rpm | 37600 | 40200 | 35600 |
| P & C (N/mm2) | 1 Hr | 0.40 | 0.40 | 0.70 |
| | 24 Hr | 9.24 | 9.42 | 9.22 |
| 14 Wk at 35 C. | Code | 71 | 74 | 77 |
| % Wt Loss | 3 Wk | 0.33 | 0.49 | 0.2 |
| | 4 Wk | 0.39 | 0.56 | 0.24 |
| | 5 Wk | 0.46 | 0.65 | 0.29 |
| | 10 Wk | 0.87 | 1.16 | 0.52 |
| | 14 Wk | 1.15 | 1.44 | 0.66 |
| Viscosity(mPas) | #6, 2.5 rpm | 206400 | 202000 | 168000 |
| | #6, 20 rpm | 41650 | 44200 | 42800 |
| P & C (N/mm2) | 1 Hr | 3.25 | 3.29 | 3.3 |
| | 24 Hr | 9.08 | 8.29 | 8.94 |

A057/1 Outer Ply PE/HDPE/PE Inner Ply LLDPE 70 u
A057/3 Outer Ply LDPE 70 u Inner Ply LLDPE 70 u Product 577 - Stability in 2L Bags

| | | Cubi 1 Liter | A057/3 2 Liter | A057/1 2 Liter |
|---|---|---|---|---|
| 7 Wk at 45 C. | Code | 62 | 65 | 68 |
| % Wt Loss | 3 Wk | 0.58 | 0.73 | 0.51 |
| | 4 Wk | 0.69 | 0.88 | 0.66 |
| | 5 Wk | 0.76 | 1.04 | 0.77 |
| | 7 Wk | 0.97 | 1.3 | 0.96 |
| Viscosity(mPas) | #6, 2.5 rpm | 157200 | 197200 | 197600 |
| | #6, 20 rpm | 40350 | 46950 | 46000 |
| P & C (N/mm2) | 1 Hr | 0.70 | 0.40 | 0.60 |
| | 24 Hr | 12.34 | 9.35 | 12.88 |
| 14 Wk at 35 C. | Code | 61 | 64 | 67 |
| % Wt Loss | 3 Wk | 0.37 | 0.27 | 0.23 |
| | 4 Wk | 0.39 | 0.32 | 0.26 |
| | 5 Wk | 0.45 | 0.37 | 0.3 |
| | 10 Wk | 0.7 | 0.64 | 0.56 |
| | 14 Wk | 0.87 | 0.79 | 0.68 |

-continued

Product 577 - Stability in 2L Bags

| | | Cubi 1 Liter | A057/3 2 Liter | A057/1 2 Liter |
|---|---|---|---|---|
| Viscosity(mPas) | #6, 2.5 rpm | 168400 | 161600 | 166400 |
| | #6, 20 rpm | 33600 | 37350 | 38500 |
| P & C (N/mm2) | 1 Hr | 2.54 | 3.01 | 3.1 |
| | 24 Hr | 12.29 | 12.04 | 12.43 |
| A057/1 | Outer Ply PE/HDPE/PE | | Inner Ply LLDPE 70 u | |
| A057/3 | Outer Ply LDPE 70 u | | Inner Ply LLDPE 70 u | |

Product 573 - Stability in 2L Bags

| | | Cubi 1 Liter | A057/3 2 Liter | A057/1 2 Liter |
|---|---|---|---|---|
| 7 wk at 45 C. | Code | 52 | 55 | 58 |
| % Wt Loss | 3 Wk | 0.11 | 0.13 | 0.08 |
| | 4 Wk | 0.13 | 0.15 | 0.09 |
| | 5 Wk | 0.15 | 0.17 | 0.10 |
| | 7 Wk | 0.17 | 0.17 | 0.10 |
| Viscosity(mPas) | #6, 2.5 rpm | 54800 | 51600 | 41200 |
| | #6, 20 rpm | 18350 | 18000 | 15750 |
| P & C (N/mm2) | 6 Hr | 0.23 | 0.25 | 0.16 |
| | 24 Hr | 1.09 | 0.82 | 0.92 |
| 14 Wk at 35 C. | Code | 51 | 54 | 57 |
| % Wt Loss | 3 Wk | 0.06 | 0.06 | 0.04 |
| | 4 Wk | 0.07 | 0.06 | 0.04 |
| | 5 Wk | 0.08 | 0.06 | 0.04 |
| | 10 Wk | 0.14 | 0.10 | 0.07 |
| | 14 Wk | 0.14 | 0.10 | 0.08 |
| Viscosity(mPas) | #6, 2.5 rpm | 54800 | 56800 | 58000 |
| | #6, 20 rpm | 17550 | 17400 | 16450 |
| P & C (N/mm2) | 6 Hr | 0.54 | 0.58 | 0.5 |
| | 24 Hr | 2.62 | 1.36 | 1.66 |
| RT | Code | 53 | 56 | 59 |
| A057/1 | Outer Ply PE/HDPE/PE | | Inner Ply LLDPE 70 u | |
| A057/3 | Outer Ply LDPE 70 u | | Inner Ply LLDPE 70 u | |

Product 275 - Stability in 2L Bags

| | | Cubi 1 Liter | A057/3 2 Liter | A057/1 2 liter |
|---|---|---|---|---|
| 7 Wk at 45 C. | Code | 42 | 45 | 48* |
| % Wt Loss | 3 Wk | 0.36 | 0.52 | 0.21 |
| | 4 Wk | 0.44 | 0.58 | 0.26 |
| | 5 Wk | 0.51 | 0.65 | 0.29 |
| | 7 wk | 0.61 | 0.76 | 0.35 |
| Viscosity(mPas) | #5, 2.5 rpm | 49600 | 51840 | 47840 |
| | #5, 20 rpm | 8020 | 8280 | 8080 |
| BONB | 15 min Prevail | 2.6 | 3.0 | 3.0 |
| | 1 Hr prevail | 19.2 | 17.6 | 18.10 |
| | 24 Hr Prevail | 30.4 | 33.4 | 23.5 |
| 14 Wk at 35 C. | Code | 41 | 44 | 47 |
| % Wt Loss | 3 Wk | 0.21 | 0.27 | 0.08 |
| | 4 Wk | 0.23 | 0.31 | 0.09 |
| | 5 Wk | 0.26 | 0.34 | 0.1 |
| | 10 Wk | 0.44 | 0.53 | 0.16 |
| | 14 Wk | 0.55 | 0.61 | 0.18 |
| Viscosity(mPas) | #5, 2.5 rpm | 54400 | 48640 | 48480 |
| | #5, 20 rpm | 8180 | 7700 | 7720 |
| BONB (Nm) | 15 min Prevail | 1.4 | 1.3 | 6.1 |
| | 1 Hr Prevail | 23.6 | 27.2 | 31.40 |
| | 24 Hr Prevail | 34.2 | 46.8 | 42.0 |
| A057/1 | Outer Ply PE/HDPE/PE | | Inner Ply LLDPE 70 u | |
| A057/3 | Outer Ply LDPE 70 u | | Inner Ply LLDPE 70 u | |

Product 542 - Stability in 2L Bags

| | | Cubi 1 Liter | A057/3 2 Liter | A057/1 2 liter |
|---|---|---|---|---|
| 7 Wk at 45 C. | Code | 32 | 35 | 38 |
| % Wt Loss | 1 Wk | 0.15 | 0.29 | 0.12 |
| | 2 Wk | 0.29 | 0.48 | 0.22 |
| | 3 Wk | 0.41 | 0.62 | 0.31 |
| | 7 Wk | 0.64 | 0.95 | 0.53 |
| Viscosity (mPas) | #2, 2.5 rpm | 1968 | 2352 | 3072 |
| | #2, 20 rpm | 656 | 710 | 866 |
| P & C (N/mm2) | 1 Hr | 1.73 | 1.33 | 2.1 |
| | 24 Hr | 9.1 | 8.5 | 9 |
| 14 Wk at 35 C. | Code | 31 | 34 | 37 |
| % Wt Loss | 3 Wk | 0.17 | 0.29 | 0.12 |
| | 4 Wk | 0.2 | 0.33 | 0.15 |
| | 5 Wk | 0.25 | 0.39 | 0.18 |
| | 10 Wk | 0.49 | 0.65 | 0.34 |
| | 14 Wk | 0.62 | 0.81 | 0.41 |
| Viscosity (mPas) | #2, 2.5 rpm | 176 | 224 | 1056 |
| | #2, 20 rpm | 160 | 220 | 452 |
| P & C (N/mm2) | 1 Hr | 2.3.6 | 2.41 | 2.51 |
| | 24 Hr | 8.7 | 8.29 | 8.61 |
| A057/1 | Outer Ply PE/HDPE/PE | | Inner Ply LLDPE 70 u | |
| A057/3 | Outer Ply LDPE 70 u | | Inner Ply LLDPE 70 u | |

Product 242 - Stability in 2L Bags

| | | Cubi 1 Liter | A057/3 2 Liter | A057/1 2 Liter |
|---|---|---|---|---|
| 7 Wk at 45 C. | Code | 22 | 25 | 28 |
| % Wt Loss | 3 Wk | 0.19 | 0.22 | 0.11 |
| | 4 Wk | 0.25 | 0.27 | 0.14 |
| | 5 Wk | 0.28 | 0.32 | 0.17 |
| | 7 Wk | 0.36 | 0.38 | 0.21 |
| Viscosity(mPas) | #3, 2.5 rpm | 2400 | 3000 | 2800 |
| | #3, 20 rpm | 655 | 800 | 750 |
| BONB | 1 Hr | 13 | 13.8 | 13.4 |
| | 4 Hr | 16.2 | 17.6 | 16.2 |
| | 24 Hr | 20.4 | 21.4 | 19.6 |
| 14 Wk at 35 C. | Code | 21 | 24 | 27 |
| % Wt Loss | 3 Wk | 0.11 | 0.13 | 0.05 |
| | 4 Wk | 0.13 | 0.16 | 0.06 |
| | 5 Wk | 0.13 | 0.17 | 0.07 |
| | 10 Wk | 0.26 | 0.31 | 0.15 |
| | 14 Wk | 0.32 | 0.37 | 0.19 |
| Viscosity(mPas) | #3, 2.5 rpm | 2440 | 1440 | 1400 |
| | #3, 20 rpm | 700 | 435 | 9 |
| BONB | 1 Hr | 12 | 12.8 | 13.80 |
| | 4 Hr | 18.7 | 18.2 | 17.50 |
| | 24 Hr | 21.3 | 19.8 | 20.3 |
| A057/1 | Outer Ply PE/HDPE/PE | | Inner Ply LLDPE 70 u | |
| A057/3 | Outer Ply LDPE 70 u | | Inner Ply LLDPE 70 u | |

Product 638 - Stability in 2L Bags

| | | Cubi 1 Liter | A057/3 2 Liter | A057/1 2 Liter |
|---|---|---|---|---|
| 7 Wk at 45 C. | Code | 12 | 15 | 18 |
| % Wt Loss | 1 Wk | 0.38 | 0.15 | 0.45 |
| | 2 Wk | 0.70 | 0.32 | 0.9 |
| | 3 Wk | 0.97 | 0.47 | 1.27 |
| | 7 Wk | 1.69 | 0.9 | 2.18 |
| Viscosity (mPas) | #3, 20 rpm | 4990 | 4745 | 5570 |
| P & C | 15 min | 0 | 0 | 0 |
| | 24 Hr | 28.0 | 25.2 | 24.6 |
| 14 Wk at 35 C. | Code | 11 | 14 | 17* |

-continued

Product 638 - Stability in 2L Bags

| | | Cubi 1 Liter | A057/3 2 Liter | A057/1 2 Liter |
|---|---|---|---|---|
| % Wt Loss | 3 Wk | 0.53 | 1.56 | 0.23 |
| | 4 Wk | 0.62 | 1.65 | 0.27 |
| | 5 Wk | 0.75 | 1.77 | 0.32 |
| | 10 Wk | 1.38 | 2.41 | 0.60 |
| | 14 Wk | 1.85 | 2.85 | 0.76 |
| Viscosity (mPas) | #3, 20 rpm | 4015 | 4175 | 3485 |
| P & C (N/mm2) | 15 min | 11.89 | 9.89 | 7.00 |
| | 24 Hr | 24.65 | 24.47 | 23.01 |

| | | |
|---|---|---|
| A057/1 | Outer Ply PE/HDPE/PE | Inner Ply LLDPE 70 u |
| A057/3 | Outer Ply LDPE 70 u | Inner Ply LLDPE 70 u |

Product 648 - Stability in 2L Bags

| | | Cubi 1 Liter | A057/3 2 Liter | A057/1 2 Liter |
|---|---|---|---|---|
| 7 Wk at 45 C. | Code | 2 | 5 | 8* |
| % Wt Loss | 3 Wk | 0.99 | 1.4 | 0.62 |
| | 4 Wk | 1.30 | 1.76 | 0.78 |
| | 5 Wk | 1.51 | 2.06 | 0.94 |
| | 7 Wk | 1.89 | 2.5 | 1.33 |
| Viscosity (mPas) | #2, 20 rpm | 586 | 606 | 712 |
| P & C | 15 min | 0.1 | 0.1 | 0 |
| | 24 Hr | 20.68 | 20.58 | 21.9 |
| 14 Wk at 35 C. | Code | 1 | 4* | 7* |
| % Wt Loss | 3 Wk | 0.60 | 0.71 | 0.28 |
| | 4 Wk | 0.78 | 0.82 | 0.31 |
| | 5 Wk | 0.78 | 0.95 | 0.38 |
| | 10 Wk | 1.37 | 1.58 | 0.70 |
| | 14 Wk | 1.76 | 1.96 | 0.91 |
| Viscosity (mPas) | #2, 20 rpm | 676 | 670 | 600 |
| P & C (N/mm2) | 15 min | 2.15 | 3.88 | 4.95 |
| | 24 Hr | 23.51 | 23.51 | 22.88 |

| | | |
|---|---|---|
| A0571/ | Outer Ply PE/HDPE/PE | Inner Ply LLDPE 70 u |
| A057/3 | Outer Ply LDPE 70 u | Inner Ply LLDPE 70 u |

Summary of Results

For all of the above products the cubitainer and the flexible container showed similar performances for all of the tests conducted. In individual tests one of the flexible containers outperformed the other and/or the cubitainer.

Overall the storage capability of the flexible containers and the cubitainers were shown to be similar.

What is claimed is:

1. In combination, a flexible container and a volume of an anaerobic adhesive product within said container, said container having a length, a width, a height, a predetermined volume, and at least one wall defining a cavity which accommodates said anaerobic adhesive product, the at least one wall being made of deformable, oxygen permeable material, such that the flexible container is sufficiently oxygen permeable to thereby maintain the anaerobic product in an uncured state and sufficiently flexible to substantially conform to the shape of at least one further container into which it may be placed, wherein a dimension of said flexible container is selected from the group consisting of said length, said width, and said height, and said dimension is a restricted size of not exceeding about 8 cm, said restricted size being calculable from said predetermined volume in cubic centimeters according to the formula:

size=5/9 wherein said volume of said anaerobic product equals said predetermined volume.

2. A combination according to claim 1, wherein the wall is made of at least one of polyethylene and polypropylene.

3. A combination according to claim 2 wherein said polyethylene or polypropylene is selected from the group consisting of linear low density polyethylene, very low density polyethylene, high density polyethylene or polypropylene or blends, co-extrusions or laminates thereof.

4. A combination according to claim 1 wherein the wall comprises at least two layers of deformable, oxygen permeable material.

5. A combination according to claim 1 wherein the wall thickness is at least 50 $\mu$m.

6. A combination according to claim 1, wherein the permeability of the wall of the container to oxygen is 25 $cm^3/m^2$-day-bar or greater.

7. A combination according to claim 1 wherein the flexible container is opaque.

8. A pack comprising:

(a) a flexible container having a predetermined volume, comprising at least one wall defining a cavity which accommodates an anaerobic adhesive product, the wall being made of a deformable, oxygen permeable material consisting essentially of a material selected from the group consisting of polyethylene, polypropylene or polyethylene/polypropylene having a permeability to oxygen of 25 $cm^3/m^2$-day-bar or greater, such that the flexible container is sufficiently oxygen permeable to maintain the anaerobic product in an uncured state and sufficiently flexible to substantially conform to a shape of a further container into which it may be placed, wherein at least one of a length, a width, and a height of the flexible container is a restricted size not exceeding about 8 cm, the restricted size being calculable for said predetermined volume in centimeters according to the formula:

size=5/9 and (b) an outer substantially rigid container adapted to receive the flexible container.

9. A pack according to claim 8 wherein the rigid container is oxygen permeable.

10. A pack according to claim 8 wherein the rigid container comprises a paperboard carton.

11. A pack according to claim 8, wherein the paperboard carton is generally flat in shape.

12. A pack according to claim 8 where the flexible container is opaque.

13. A pack according to claim 8, wherein the outer container conforms to the flexible container and, when containing a mass of anaerobic product, to a shape in which a distance from any point in the product to a closest wall of the flexible container is less than or equal to 4 cm.

14. A pack according to claim 8 wherein said material is selected from the group consisting of linear low density polyethylene, very low density polyethylene, high density polyethylene or polypropylene or blends, co-extrusions or laminates thereof.

* * * * *

UNITED STATES PATENT AND TRADEMARK OFFICE

CERTIFICATE OF CORRECTION

PATENT NO. : 6,502,697 B1 
DATED : January 7, 2003
INVENTOR(S) : Alan T. Crampton, Hilary E. Bryan and Fergal A. Gordon It is certified that error appears in the above-identified patent and that said Letters Patent is hereby corrected as shown below:

Column 1,
Line 16, change "4,180 640" to -- 4,180,640 --

Column 9,
Line 30, change "Methyacrylate" to -- Methacrylate --

Signed and Sealed this

Eighth Day of April, 2003

JAMES E. ROGAN
*Director of the United States Patent and Trademark Office*